US008622233B2

(12) United States Patent
Tsuyuki et al.

(10) Patent No.: US 8,622,233 B2
(45) Date of Patent: Jan. 7, 2014

(54) PACKAGING CONTAINER

(75) Inventors: Hiroshi Tsuyuki, Kanagawa (JP); Tomomi Kobayashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/302,905

(22) Filed: Nov. 22, 2011

(65) Prior Publication Data

US 2012/0305552 A1 Dec. 6, 2012

(30) Foreign Application Priority Data

May 30, 2011 (JP) ..... 2011-121081

(51) Int. Cl.
*B65D 5/56* (2006.01)
*B65F 1/06* (2006.01)
*B65D 77/04* (2006.01)

(52) U.S. Cl.
CPC .. *B65F 1/06* (2013.01); *B65D 77/04* (2013.01)
USPC ..... 220/495.06

(58) Field of Classification Search
CPC ..... B65F 1/068; B65F 1/06; B65D 77/04
USPC ..... 220/495.06, 495.01, 495.08, 920; 206/592, 594, 591, 586, 521; 53/472, 53/396; 229/117.35, 117.27
IPC ..... B65D 5/60, 5/58, 5/56
See application file for complete search history.

(56) References Cited

U.S. PATENT DOCUMENTS

| | | | | |
|---|---|---|---|---|
| 2,293,589 | A * | 8/1942 | Calvert | 206/524.6 |
| 3,192,680 | A * | 7/1965 | Mantell et al. | 53/449 |
| 5,641,068 | A * | 6/1997 | Warner | 206/523 |
| 6,206,224 | B1 * | 3/2001 | Potts et al. | 220/495.06 |
| 2002/0139706 | A1 * | 10/2002 | Fujii | 206/523 |
| 2005/0067474 | A1 * | 3/2005 | Wang | 229/117.35 |
| 2009/0277911 | A1 * | 11/2009 | Koide et al. | 220/495.08 |

FOREIGN PATENT DOCUMENTS

| | | | | |
|---|---|---|---|---|
| JP | 03200538 | A * | 9/1991 | B65D 5/60 |
| JP | 11-278497 | | 10/1999 | |
| JP | 2009-035269 | | 2/2009 | |

* cited by examiner

*Primary Examiner* — Robert J Hicks
(74) *Attorney, Agent, or Firm* — Sughrue Mion, PLLC

(57) ABSTRACT

A packaging container includes an outer container having a containing space and a passage opening, and a packaging bag for containing an object. The packaging bag includes a containing portion, an opening portion, and a handle portion. The handle portion includes strip-like members each connected to the containing portion at two connection portions. The handle portion has a length equal to or larger than half a length of the object along the passage opening when the handle portion is extended in a direction along the passage opening. When the handle portion is extended in a direction through the passage opening, the handle portion has a length with which the handle portion is allowed to protrude away from a surface of the object adjacent to the passage opening toward the passage opening and the connection portions are located at positions separated away from the surface toward the passage opening.

13 Claims, 5 Drawing Sheets

PACKAGING CONTAINER

CROSS-REFERENCE TO RELATED APPLICATIONS

This application is based on and claims priority under 35 USC 119 from Japanese Patent Application No. 2011-121081 filed May 30, 2011.

BACKGROUND

Technical Field

The present invention relates to a packaging container.

SUMMARY

According to an aspect of the invention, a packaging container includes an outer container having a box-like shape and having a containing space capable of containing an object therein and a passage opening allowing the object to pass therethrough; and a packaging bag contained in the outer container in a state in which the packaging bag contains the object. The packaging bag includes a containing portion capable of containing the object, an opening portion formed in the containing portion and allowing the object to pass therethrough, and a handle portion graspable by a user. The handle portion includes plural strip-like members each having ends connected to the containing portion at two connection portions that are separated from each other on an edge of the opening portion. The handle portion has a length with which the handle portion is allowed to protrude away from a surface of the object adjacent to the passage opening toward the passage opening when the packaging bag containing the object is contained in the outer container and the handle portion is extended in a direction through the passage opening. The handle portion has a length equal to or larger than half a length of the object along the passage opening when the packaging bag containing the object is contained in the outer container and the handle portion is extended in a direction along the passage opening. The connection portions at which the handle portion is connected to the containing portion are located at positions separated away from the surface of the object adjacent to the passage opening toward the passage opening when the packaging bag containing the object is contained in the outer container and the handle portion is extended in the direction through the passage opening.

BRIEF DESCRIPTION OF THE DRAWINGS

Exemplary embodiments of the present invention will be described in detail based on the following figures, wherein.

DETAILED DESCRIPTION

Figure 1:
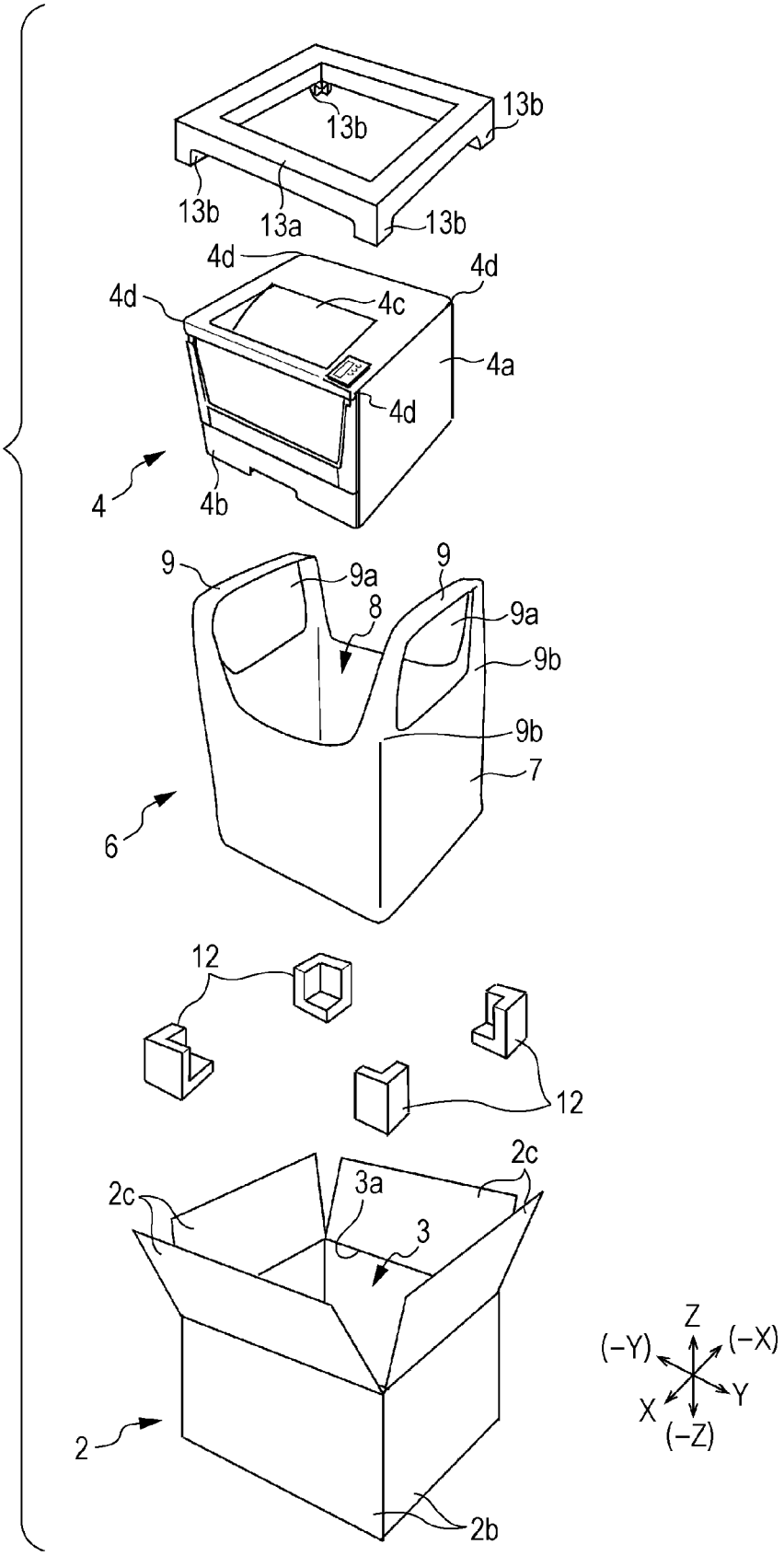
FIG. 1 is an overall view of a packaging container according to a first exemplary embodiment of the present invention, illustrating a state in which components are taken out of the outer container.

Hereinafter, exemplary embodiments of the present invention will be described with reference to the drawings. However, the present invention is not limited to the exemplary embodiments described below.

For ease of understanding, in the drawings, the front-back direction, the left-right direction, and the up-down direction will be respectively referred to as the X-axis direction, the Y-axis direction, and the Z-axis direction. The directions or the sides indicated by arrows X, −X, Y, −Y, Z, and −Z will be respectively referred to as forward, backward, rightward, leftward, upward, and downward, or the front side, the back side, the right side, the left side, the upper side, and the lower side.

In the drawings, "○" with "•" in it represents an arrow extending from the back side to the front side of the plane of the drawings, and "○" with "x" in it represents an arrow extending from the front side to the back side of the plane of drawings.

For ease of understanding, components that are not necessary for the description are omitted from the drawings.

First Exemplary Embodiment

FIG. 1 is an overall view of a packaging container according to a first exemplary embodiment of the present invention, illustrating a state in which components are taken out of the outer container.

Figure 2A:
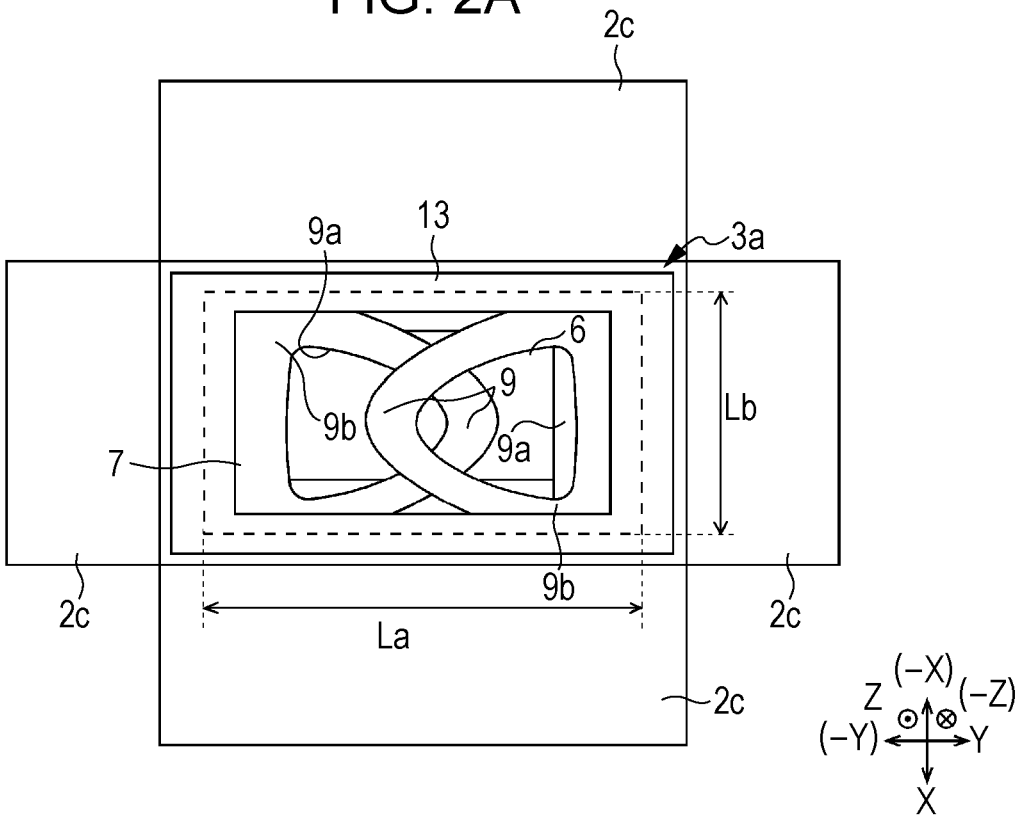
FIGS. 2A and 2B illustrate the packaging container according to the first exemplary embodiment, FIG. 2A being a plan view illustrating a state in which upper part of the outer container has been opened from a packaged state, and FIG. 2B being a sectional view illustrating the packaged state.
Figure 2B:
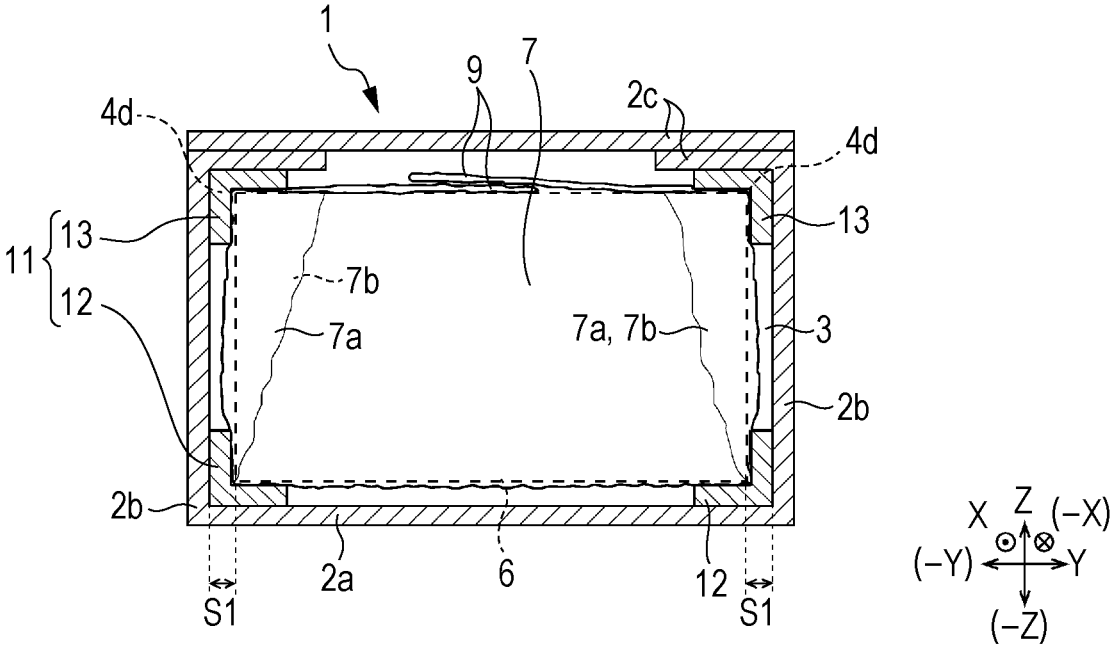

FIGS. 2A and 2B illustrate the packaging container according to the first exemplary embodiment, FIG. 2A being a plan view illustrating a state in which upper part of the outer container has been opened from a packaged state, and FIG. 2B being a sectional view illustrating a packaged state.

Referring to FIGS. 1 to 2B, a packaging container 1 according to a first exemplary embodiment includes an outer box 2, which is an example of an outer container, having a rectangular-parallelepiped shape. The outer box 2 according to the first exemplary embodiment is made of corrugated fiberboard. However, the outer box 2 is not limited to a corrugated fiberboard box, and may be a container box of any known type, such as a plastic box. The outer box 2 has a bottom portion 2*a*; front, back, left, and right side portions 2*b*; and lid portions 2*c* that are integrally formed with upper ends of the side portions 2*b*. A containing space 3 is a space formed by being surrounded by the bottom portion 2*a*, the side portions 2*b*, and the lid portions 2*c* when the lid portions 2*c* are closed. When the lid portions 2*c* are open as illustrated in FIG. 2A, a passage opening 3*a* is formed at the top of the containing space 3.

A printer 4, which is an example of an object and an example of an image forming apparatus, is contained in the containing space 3 in the outer box 2. The printer 4 includes an apparatus body 4*a*, a sheet feed tray 4*b*, and an output tray 4*c*. The sheet feed tray 4*b*, which is an example of a containing section for containing a medium on which an image is to be recorded, is removably supported in a lower part of the apparatus body 4*a*. The output tray 4*c*, which is an example of an output section to which a medium on which an image has be recorded is output, is formed on an upper surface of the apparatus body 4*a*.

Referring to FIG. 2A, the printer 4 according to the first exemplary embodiment has a length La in the left-right direction that is larger than a length Lb in the front-back direction. That is, for the printer 4 and the outer box 2 for containing the printer 4, the left-right direction is the longitudinal direction and the front-back direction is the transversal direction.

Figure 3:
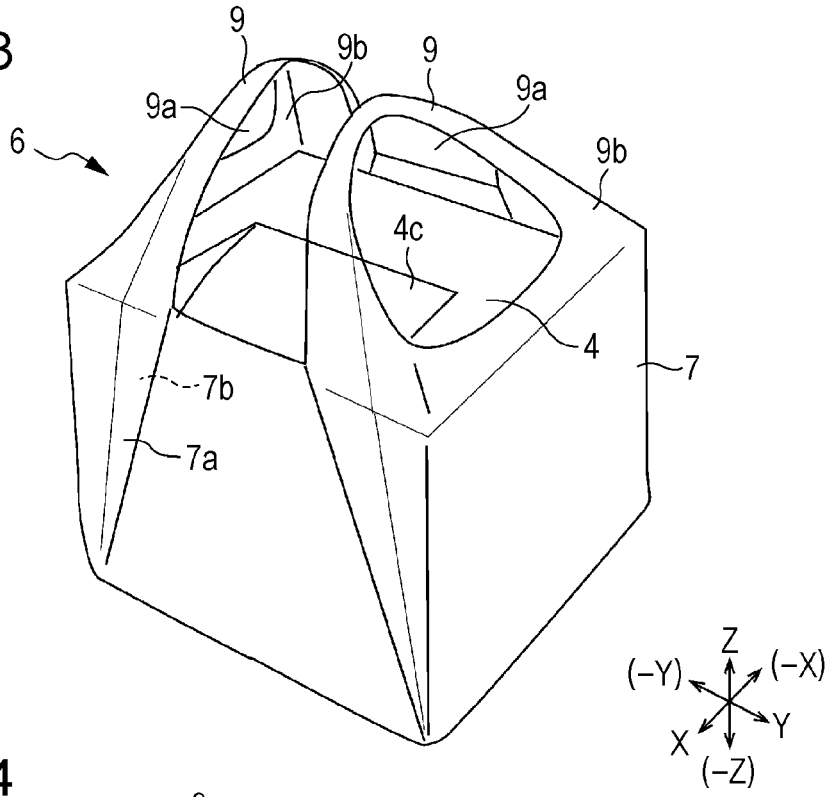
FIG. 3 illustrates the packaging container according to the first exemplary embodiment, illustrating a state in which an upper cushioning member and an object have been taken out from the outer container that has been in the packaged state.

FIG. 3 illustrates the packaging container according to the first exemplary embodiment, illustrating a state in which an upper cushioning member and an object have been taken out from the outer container that has been in the packaged state.

Figure 4:
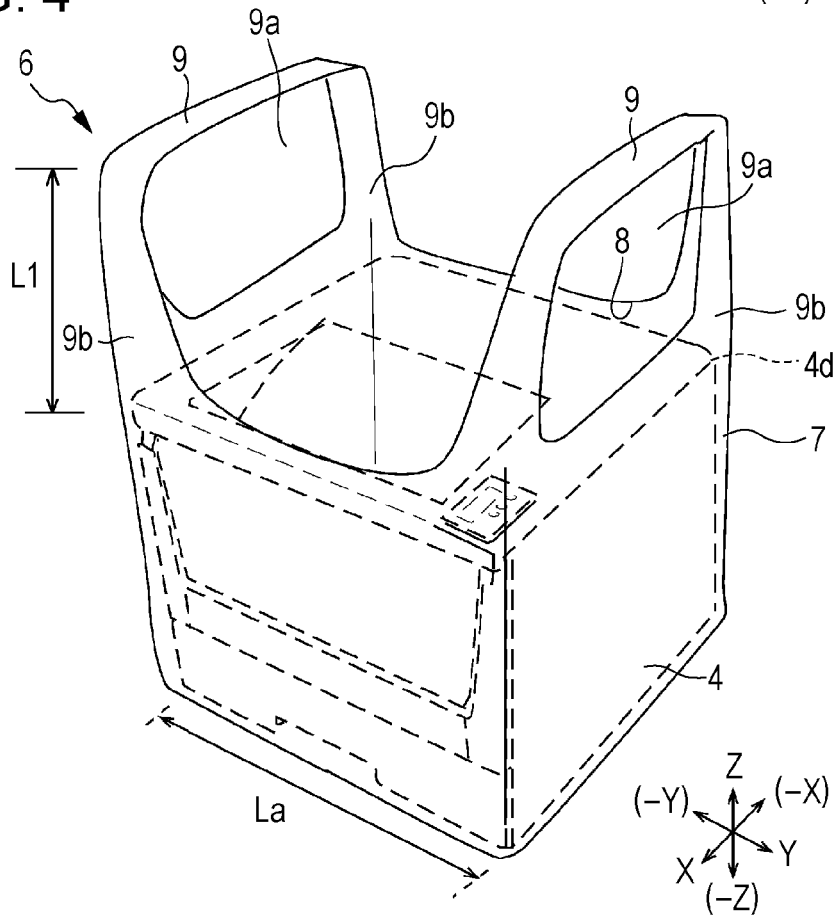
FIG. 4 illustrates a state after the object according to the first exemplary embodiment has been taken out from the outer container and before the object is taken out of a packaging bag.

FIG. 4 illustrates a state after an object according to the first exemplary embodiment has been taken out from the outer container and before the object is taken out of a packaging bag.

Referring to FIGS. 1 to 4, the printer 4 is contained in the outer box 2 in a state in which the printer 4 is contained in a plastic bag 6, which is an example of a packaging bag. The plastic bag 6 according to the first exemplary embodiment includes a containing portion 7, an opening portion 8, and a pair of handle portions 9. The printer 4 is contained in the containing portion 7. The opening portion 8 allows the printer 4 to pass therethrough when the printer 4 is taken out of the containing portion 7.

The plastic bag 6 according to the first exemplary embodiment is made of polyethylene. However, the material of the plastic bag 6 is not limited thereto, and may be another known plastic. The thickness of the plastic bag 6 may be in the range of about 0.02 to 0.1 mm. In particular, if the weight of the printer 4 is about 5 kg, a polyethylene film having a thickness in the range of about 0.04 to 0.06 mm may be used. However, the plastic bag 6 may be made of any plastic material having any thickness as long as the plastic bag 6 has a strength that prevents the plastic bag 6 from being broken when the handle portions 9 are held while the printer 4 is contained in the plastic bag 6.

In the plastic bag 6 according to the first exemplary embodiment, each of the pair of handle portions 9 has a strip-like member. Ends of the strip-like member of each of the handle portions 9 are connected to the containing portion 7 at two positions at the edge of the opening portion 8 that are separated from each other in the front-back direction. Therefore, each of the handle portions 9 has a loop-like shape, and a space 9*a* into which a user may insert his/her finger or arm is formed. In the first exemplary embodiment, the distance between the handle portions 9 in the left-right direction is larger than the distance between connection portions 9*b* at which the handle portions 9 are connected to the containing portion 7 in the front-back direction. That is, the pair of handle portions 9 according to the first exemplary embodiment are disposed on both sides in the longitudinal direction.

In the first exemplary embodiment, the handle portions 9 are integrally formed with the containing portion 7 in order to reduce production cost. Alternatively, strip-shaped handle portions that are independent members may be connected to the containing portion 7 by using adhesive, adhesive tape, or the like.

As illustrated in FIGS. 3 and 4, each of the handle portions 9 according to the first exemplary embodiment has a length with which the handle portion 9 is allowed to protrude away from the upper surface of the printer 4, which is a surface of the printer 4 adjacent to the passage opening 3*a*, toward the passage opening 3*a* when the plastic bag 6 containing the printer 4 is contained in the outer box 2 and the handle portion 9 is extended in an upward direction through the passage opening 3*a*.

Moreover, each of the handle portions 9 according to the first exemplary embodiment has a length L1 that is equal to or larger than half the length La of the printer 4 along the passage opening 3*a*, when the plastic bag 6 containing the printer 4 is contained in the outer box 2 and the handle portion 9 is extended in a horizontal direction along the passage opening 3*a*. That is, L1≥La/2, where L1 is the length of the handle portion 9 and La is the width of the printer 4 in the longitudinal direction. As illustrated in FIG. 2B, when the passage opening 3*a* of the outer box 2 is closed, the handle portions 9 according to the first exemplary embodiment are contained in the outer box 2 in a state in which the handle portions 9 extend in the horizontal direction along the passage opening 3*a*. As illustrated in FIG. 2A, each of the handle portions 9 on the left and right sides, which is configured such that L1≥La/2, are folded in such a way that ends of the handle portions 9 overlap in the up-down direction in a state in which the handle portions 9 extend in the horizontal direction.

As illustrated in FIG. 4, in the handle portions 9 according to the first exemplary embodiment, the positions of the connection portions 9*b*, at which the handle portions 9 and the containing portion 7 are connected each other, are located at positions separated away from the surface of the printer 4 adjacent to the passage opening 3*a* toward the passage opening 3*a* when the plastic bag 6 containing the printer 4 is contained in the outer box 2 and the handle portions 9 are extended upward. That is, in the first exemplary embodiment, the size of the plastic bag 6 is determined so that corners 4*d* of the upper surface of the printer 4 are not exposed to the outside and covered with the plastic bag 6 when the printer 4 is contained in the plastic bag 6. Therefore, when the outer box 2 is closed as illustrated in FIG. 2B, the connection portions 9*b* of the plastic bag 6 according to the first exemplary embodiment are disposed inside the corners 4*d* of the outer ends of the printer 4.

Referring to FIGS. 2B, 3, and 4, when the handle portions 9 of the plastic bag 6 according to the first exemplary embodiment extend in the horizontal direction along the passage opening 3*a*, excess portions 7*a* of the containing portion 7 are disposed outside the connection portions 9*b* and portions 7*b* of the containing portion 7 extending along the outer surface of the printer 4. Therefore, as illustrated in FIG. 3, when the handle portions 9 are held together (by a single hand of a user, for example), the excess portions 7*a* of the containing portion 7 are folded into strip-like shapes so as to extend along directions in which the handle portions 9 extend and along the outer surface of the printer 4.

Referring to FIGS. 1 to 2B, in the packaging container 1 according to the first exemplary embodiment, when the printer 4 contained in the plastic bag 6 is contained in the outer box 2, a cushioning member 11, which is an example of a cushioning member for absorbing an external force, is disposed between the plastic bag 6 and the outer box 2. The cushioning member 11 according to the first exemplary embodiment includes four lower cushions 12 and an upper cushion 13. The lower cushions 12 are disposed at four corners in a bottom part of the outer box 2. The upper cushion 13 is disposed on an upper part of the printer 4. The upper cushion 13 includes a frame portion 13*a* and cushioning bodies 13*b*. An opening is formed in the middle of the frame portion 13*a* to reduce the weight. The cushioning bodies 13*b* are formed at four corners of a bottom surface of the frame portion 13*a* and have shapes that are vertically symmetric with the lower cushions 12.

Referring to FIGS. 2A and 2B, the thickness and the size of the cushioning member 11 according to the first exemplary embodiment are determined so that the width of a gap S1 between the inner surface of the outer box 2 and the outer surface of the printer 4 is 20 mm. The width of the gap S1 is not limited to 20 mm. The width of the gap S1 may be equal to or smaller than 30 mm, which is smaller than 40 mm used in existing packaging containers, or may be equal to or smaller than 10 mm if the processing accuracy of the cushioning member 11 allows.

The cushioning member 11 according to the first exemplary embodiment may be made of any appropriate known material, such as styrofoam or corrugated fiberboard.

Functions of First Exemplary Embodiment

To take out the printer 4 from the packaging container 1 according to the first exemplary embodiment, which has the structure described above, the lid portions 2*c* of the outer box 2 are opened first and the packaging container 1 enters a state illustrated in FIG. 2A. Then, the upper cushion 13 is removed. The plastic bag 6 is lifted by holding the two handle portions 9, and the printer 4 is taken out of the packaging container together with the plastic bag 6 as illustrated in FIG. 3. Then, the printer 4 is moved to an installation position while holding the handle portions 9. As illustrated in FIG. 4, the printer 4 is taken out of the plastic bag 6 through the opening portion 8, and the printer 4 is installed in place.

Figure 5:
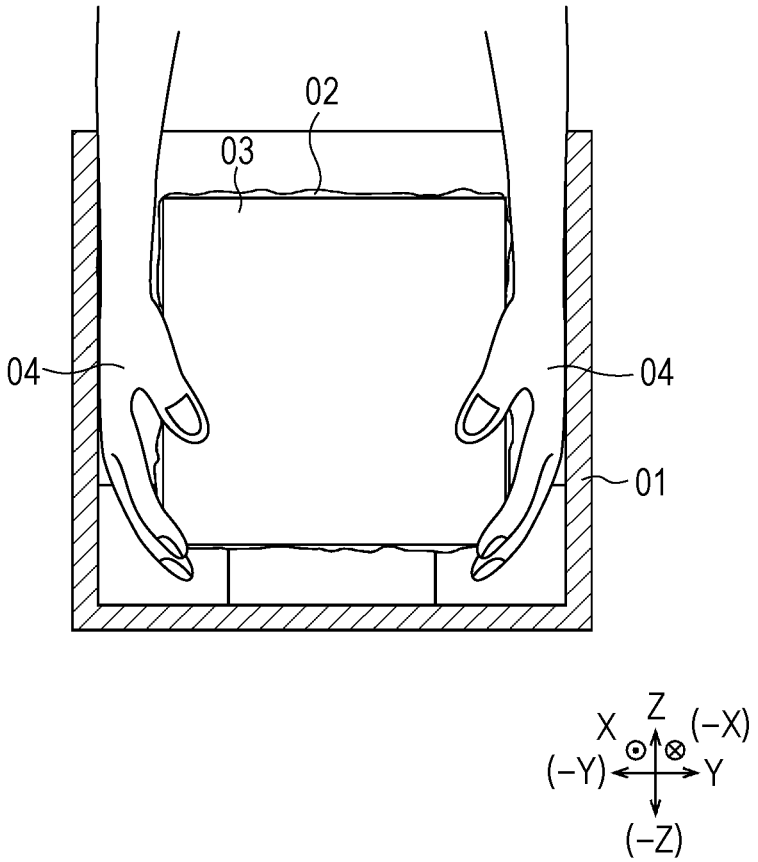
FIG. 5 illustrates a state in which an object is being taken out of an existing packaging container.

FIG. 5 illustrates a state in which an object is being taken out of an existing packaging container.

Referring to FIG. 5, with the existing structure described in Japanese Unexamined Patent Application Publication No. 2009-35269, it is necessary for a user to insert his/her hands 04 into a space between the outer box 01 and the object 03 to take out an object 03 from the outer box 01 because the packaging bag 02 does not have handles. Therefore, the existing technology has a problem in that it is impossible for a user to insert his/her hands 04 if the gap between the outer box 01 and the object 03 is too narrow. In order to allow a user to inert his/her hands 04, the width of the gap between the outer box 01 and the object 03 is usually set equal to or larger than about 40 mm. Therefore, in order to allow a user to insert his/her hands 04 from both sides as illustrated in FIG. 5, the size of the outer box 01 is larger than that of the object 03 by about 40 mm×2=80 mm, so that there is a problem in that the size of the package box 01 is increased.

In contrast, with the first exemplary embodiment, the plastic bag 6, which is used to cover the outer surface of the printer 4 to protect the printer 4 from dust, has the handle portions 9, so that it is possible for a user to take the printer 4 out of the packaging container 1 by holding the handle portions 9 and lifting the plastic bag 6. Therefore, the gap S1 between the outer box 2 and the printer 4 may be narrower than that of existing packaging containers, so that it is possible to reduce the size of the outer box 2 as compared with existing packaging containers. By reducing the size of the outer box 2, it is possible to store a larger number of packaging containers in a warehouse, the area needed to store the packaging containers is reduced, and the cost of storing the packaging containers is reduced. Moreover, by reducing the size of the outer box 2, the volume of the outer box 2 discarded after installing the printer 4 is reduced, which leads to waste reduction.

With the existing technology, when handling an object that is relatively large and heavy, such as the printer 4, it is necessary for an operator to lift the object with both hands to take out the object from the outer box 2. Therefore, if there is large friction between the printer 4 and the outer box 2 due to static electricity or the like, it is difficult for a single operator to hold the outer box 2 with his/her hands occupied. In such a case, two operators are necessary, so that the operability is impaired.

In contrast, with the first exemplary embodiment, it is possible for an operator to hold the two handle portions 9 with one hand and take out the printer 4 while holding the outer box 2 with another hand. As a result, the operability is improved.

In particular, because L1≥La/2 is satisfied in the first exemplary embodiment, when the lid portions 2*c* of the outer box 2 are closed, the handle portions 9 are containable in the outer box 2 so as to overlap in the up-down direction as illustrated in FIG. 2A. Therefore, after the upper cushion 13 has been removed, a user may easily insert his/her hand into the spaces 9*a* of the two handle portions 9 that overlap in the up-down direction. As a result, as compared with the case where the handle portions 9 are not contained in the outer box 2 in an overlapping manner, the two handle portions 9 may be easily held with a single hand.

As illustrated in FIGS. 3 and 4, in the first exemplary embodiment, the size of the plastic bag 6 has a margin when the printer 4 is contained in the plastic bag 6, so that the containing portion 7 has the excess portions 7*a* when the handle portions 9 are held and lifted. The excess portions 7*a* of the containing portion 7 are disposed so as to overlap the outer sides of the portions 7*b* of the containing portion 7 extending along the outer surface of the printer 4. The strength of the plastic bag 6 is increased because a force that is generated when the handle portions 9 are held and lifted is applied to both the excess portions 7*a* and the portions 7*b* extending along the outer surface. Therefore, the plastic bag 6 is not easily broken when the handle portions 9 are held and lifted, and occurrence of an accident such that the plastic bag 6 is broken and the printer 4 is dropped and broken during operation is reduced.

In particular, as illustrated in FIG. 2B, in the first exemplary embodiment, when the printer 4 is contained in the outer box 2, the excess portions 7*a* have strip-like shapes and extend along the outer sides of the portions 7*b* extending along the outer surface of the printer 4. Therefore, when the handle portions 9 are lifted in this state, strip-shaped portions in which the excess portions 7*a* and the portions 7*b* extending along the outer surface of the printer 4 overlap are naturally and easily formed.

In the first exemplary embodiment, the two handle portions 9 are disposed so as to be separated from each other in the longitudinal direction. As compared with the case where the handle portions 9 are disposed on both sides in the transversal direction, the excess portions 7*a* are easily formed into large strips. Therefore, as compared with the case where the handle portions 9 are disposed on both sides in the transversal direction, the plastic bag 6 is not easily broken.

In the first exemplary embodiment, the connection portions 9*b* between the handle portions 9 and the containing portion 7 are disposed above the corners 4*d* of the printer 4, so that the corners 4*d* are not exposed to the outside when the printer 4 is contained in the plastic bag 6. Therefore, as compared with the case where the corners 4*d* of the printer 4 are exposed to the outside, the printer 4 is not easily dropped out of the containing portion 7.

Second Exemplary Embodiment

A second exemplary embodiment of the present invention will be described below. In the description of the second exemplary embodiment, the elements the same as those of the first exemplary embodiment will be denoted by the same numerals and detailed description of such elements will be omitted.

The second exemplary embodiment differs from the first exemplary embodiment in the following respects, but has the same structure as that of the first exemplary embodiment in other respects.

Figure 6:
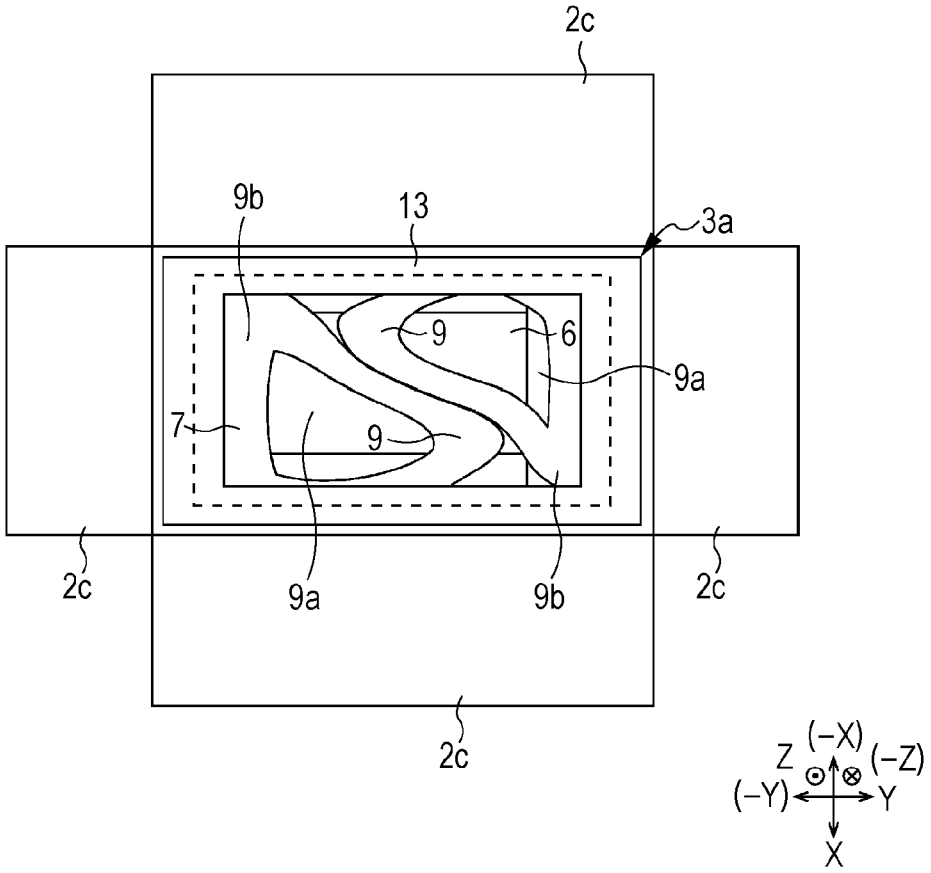
FIG. 6 is a plan view of a packaging container according to a second exemplary embodiment, corresponding to FIG. 2A for the first exemplary embodiment.

FIG. 6 is a plan view of a packaging container according to the second exemplary embodiment, corresponding to FIG. 2A of the first exemplary embodiment.

Referring to FIG. 6, in a packaging container 1 according to the second exemplary embodiment, two handle portions 9 are contained so as not to overlap and so as to be displaced from each other in the front-back direction.

Functions of Second Exemplary Embodiment

With the packaging container 1 according to the second exemplary embodiment, which has the structure described above, as compared with the case where the handle portions 9 are contained disorderly or in an entangled state, the handle portions 9 may be easily held and the operability is improved.

Third Embodiment

A third exemplary embodiment of the present invention will be described below. In the description of the third exemplary embodiment, the elements the same as those of the first exemplary embodiment will be denoted by the same numerals and detailed description of such elements will be omitted.

The third exemplary embodiment differs from the first exemplary embodiment in the following respects, but has the same structure as that of the first exemplary embodiment in other respects.

Figure 7:
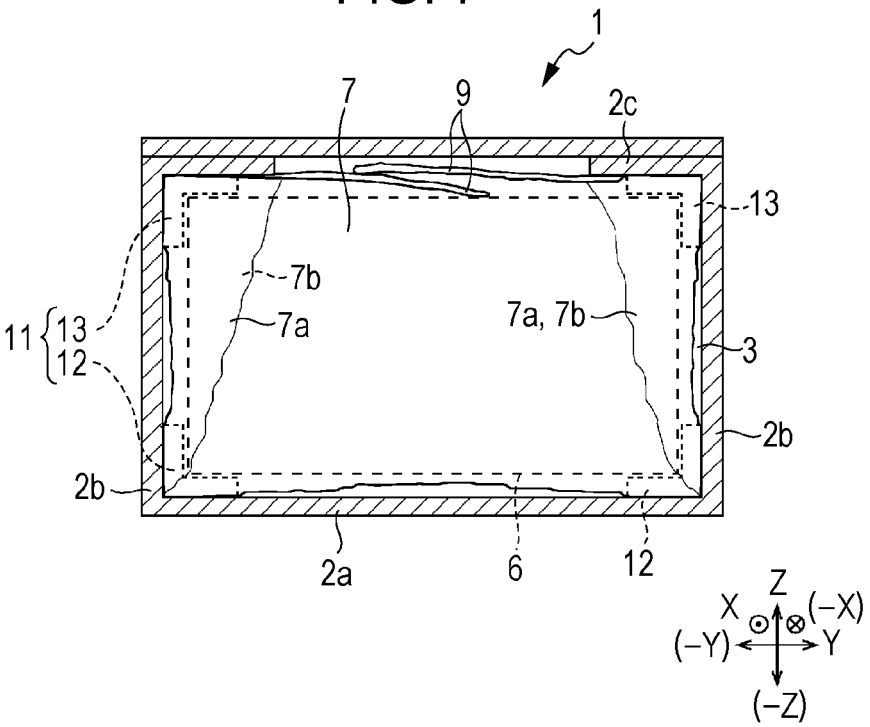
FIG. 7 is a sectional view of a packaging container according to a third exemplary embodiment, corresponding to FIG. 2B for the first exemplary embodiment.

FIG. 7 is a plan view of a packaging container according to the third exemplary embodiment, corresponding to FIG. 2B of the first exemplary embodiment.

Referring to FIG. 7, in a packaging container 1 according to the third exemplary embodiment, the cushioning member 11 is contained in the plastic bag 6, in contrast to the first embodiment in which the cushioning member 11 is disposed outside the plastic bag 6.

Functions of Third Exemplary Embodiment

With the packaging container 1 according to the third exemplary embodiment, which has the structure described above, when a user holds the handle portions 9 of the plastic bag 6 and lifts the plastic bag 6, the cushioning member 11 is taken out of the packaging container 1 together with the printer 4. When the user takes out the plastic bag 6 out of the outer box 2 and carries the plastic bag 6 to an installation position of the printer 4 by holding the handle portions 9, the plastic bag 6 may contact a desk, slip off a user's hand, or a shock may be applied to the plastic bag 6 if handled roughly. Even in such a case, breakage or the like of the printer 4 is reduced because the shock is absorbed by the cushioning member 11. In the third exemplary embodiment, the plastic bag 6 is in contact with the inner surface of the outer box 2. Therefore, it is expected that the friction is small as compared with the case where the cushioning member 11 is in contact with the inner surface of the outer box 2. That is, it is expected that the plastic bag 6 may be taken out more easily.

Modifications

The present invention is not limited to the exemplary embodiments described above, and may be modified in various ways within the scope of the present invention described in the claims. Modifications (H01) to (H08) of the exemplary embodiments of the present invention will be described below.

(H01) In the exemplary embodiments described above, a printer, which is an example of an image forming apparatus, is used as an object. However, this is not limited thereto. The packaging container may be used for any goods including other image forming apparatuses such as a copier and a fax, consumables such as toner cartridges, and electronic appliances such as a personal computer and a liquid crystal display.

(H02) In the exemplary embodiments described above, the number of handle portions 9 is two because the plastic bag 6 may be handled easily in this case. However, this is not limited thereto. The number of handle portions may be three or more. For example, if an object has a large size, the handle portions 9 may be disposed at four positions in plan view. If the object has a triangular or pentagonal shape, the number of handle portions 9 may be three, five, or more. In such cases, the length of the handle portions 9 may be determined so that the three or more handle portions 9 may be held with a single hand. However, the length many determined so that the handle portions 9 may be held with both hands or so that different numbers of handle portions 9 may be handled with the right hand and with the left hand.

(H03) In the exemplary embodiments described above, the length L1 of the handle portion 9 satisfies $L1 \geq La/2$. However, this is not limited thereto. The length L1 may satisfy $L1 < La/2$.

(H04) In the exemplary embodiments described above, the positions of the connection portions 9*b* at which the handle portions 9 are connected to the containing portion 7 are disposed above the corners 4*d* of the printer 4. However, this is not limited thereto. The connection portions 9*b* may be disposed below the corners.

(H05) In the exemplary embodiments described above, the strength of the plastic bag 6 is increased by using the excess portions 7*a*. However, this is not limited thereto. For example, if the plastic bag 6 has a sufficient strength, the excess portions 7*a* may be disposed so as not to overlap the portions 7*b* extending along the outer surface.

(H06) In the exemplary embodiments described above, the handle portions 9 are disposed on both sides in the longitudinal direction. However, this is not limited thereto. The handle portions 9 may be disposed on both sides in the transversal direction.

(H07) In the third exemplary embodiment described above, the cushioning member 11 is (both the lower cushions 12 and the upper cushion 13 are) contained in the plastic bag 6. However, this is not limited thereto. For example, only the lower cushion 12 may be contained in the plastic bag 6, and the upper cushion 13 may be disposed outside the plastic bag 6 as in the first and second exemplary embodiments.

(H08) In the exemplary embodiments described above, the structure of the cushioning member 11 is not limited to those described in the exemplary embodiments. In accordance with the shape of an object, any appropriate number of cushioning members having any appropriate shapes may be used. The upper cushion 13 is an integrated structure including the frame portion 13*a*. However, this is not limited thereto and may be modified in any appropriate way. For example, the upper cushion 13 may have a structure the same as that of the lower cushion 12 or a structure including a pair of right upper cushions connected to each other and a pair of left upper cushions connected to each other.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A packaging container for containing an object comprising:

an outer container having a containing space capable of containing the object therein and a passage opening capable of allowing the object to pass therethrough; and a packaging bag contained in the outer container, and the packaging bag includes:

a containing portion capable of containing the object, an opening portion formed in the containing portion capable of allowing the object to pass therethrough, and a handle portion graspable by a user, wherein the handle portion includes a plurality of first strips each having ends connected to the containing portion at two connection portions that are separated from each other on an edge of the opening portion, wherein the handle portion has a length with which the handle portion is allowed to protrude away from a surface of an object adjacent to the passage opening toward the passage opening when the packaging bag containing the object is contained in the outer container and the handle portion is extended in a direction through the passage opening, wherein the handle portion has a length equal to or larger than half a length of the object along the passage opening when the packaging bag containing the object is contained in the outer container and the handle portion is extended in a direction along the passage opening, wherein the connection portions at which the handle portion is connected to the containing portion are located at positions separated away from the surface of the object adjacent to the passage opening toward the passage opening when the packaging bag containing the object is contained in the outer container and the handle portion is extended in the direction through the passage opening, and wherein, when the passage opening of the outer container is closed, the handle portion is contained in the outer container in a state in which the handle portion extends in the direction along the passage opening such that ends of the handle portion overlap in a vertical direction.

2. The packaging container according to claim 1, wherein the connection portions at which the handle portion is connected to the containing portion are disposed further inward than an outer end of the object with respect to the direction in which the handle portion extends, and in a state in which the handle portion extends in the direction along the passage opening, an excess portion of the containing portion is located outside a portion of the containing portion extending along an outer surface of the object.

3. The packaging container according to claim 1, wherein, when the plurality of first strips of the handle portion are grasped together, the excess portion of the containing portion is folded into a second strip so as to extend along an extension line of the handle portion and along the outer surface of the object.

4. The packaging container according to claim 2, wherein, when the plurality of first strips of the handle portion are grasped together, the excess portion of the containing portion is folded into a second strip so as to extend along an extension line of the handle portion and along the outer surface of the object.

5. The packaging container according to claim 3, wherein a distance between the plurality of first strips of the handle portion is larger than a distance between the connection portions at which the handle portion is connected to the containing portion.

6. The packaging container according to claim 4, wherein a distance between the plurality of first strips of the handle portion is larger than a distance between the connection portions at which the handle portion is connected to the containing portion.

7. The packaging container according to claim 1, further comprising:

a cushioning member disposed in the packaging bag and between the object and the outer container with the packaging bag therebetween, the cushioning member absorbing a shock.

8. The packaging container according to claim 2, further comprising:

a cushioning member disposed in the packaging bag and between the object and the outer container with the packaging bag therebetween, the cushioning member absorbing a shock.

9. The packaging container according to claim 3, further comprising:

a cushioning member disposed in the packaging bag and between the object and the outer container with the packaging bag therebetween, the cushioning member absorbing a shock.

10. The packaging container according to claim 4, further comprising:

a cushioning member disposed in the packaging bag and between the object and the outer container with the packaging bag therebetween, the cushioning member absorbing a shock.

11. The packaging container according to claim 5, further comprising:

a cushioning member disposed in the packaging bag and between the object and the outer container with the packaging bag therebetween, the cushioning member absorbing a shock.

12. The packaging container according to claim 6, further comprising:

a cushioning member disposed in the packaging bag and between the object and the outer container with the packaging bag therebetween, the cushioning member absorbing a shock.

13. The packaging container according to claim 1, wherein an overlap portion is placed at the center area of the outer container.

* * * * *